US007747193B2

(12) United States Patent
Mase

(10) Patent No.: US 7,747,193 B2
(45) Date of Patent: Jun. 29, 2010

(54) DEVELOPING DEVICE WITH DETACHABLE TONER CARTRIDGE AND IMAGE FORMING APPARATUS HAVING THE SAME

(75) Inventor: Soichiro Mase, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 118 days.

(21) Appl. No.: 12/035,844

(22) Filed: Feb. 22, 2008

(65) Prior Publication Data

US 2008/0298837 A1 Dec. 4, 2008

(30) Foreign Application Priority Data

Mar. 1, 2007 (JP) ..... 2007-051423

(51) Int. Cl.
*G03G 15/08* (2006.01)

(52) U.S. Cl. ..... 399/119

(58) Field of Classification Search ..... 399/119, 399/258, 260, 111, 106
See application file for complete search history.

(56) References Cited

U.S. PATENT DOCUMENTS

| | | | | |
|---|---|---|---|---|
| 6,584,293 | B1 * | 6/2003 | Wang et al. | 399/258 |
| 2007/0212120 | A1 * | 9/2007 | Sato | 399/262 |
| 2008/0080903 | A1 * | 4/2008 | Noguchi | 399/262 |
| 2008/0205939 | A1 * | 8/2008 | Mase et al. | 399/254 |
| 2008/0317511 | A1 * | 12/2008 | Mase et al. | 399/262 |
| 2009/0035024 | A1 * | 2/2009 | Sato | 399/262 |
| 2009/0087216 | A1 * | 4/2009 | Sakuma | 399/106 |

FOREIGN PATENT DOCUMENTS

| | | |
|---|---|---|
| JP | 05-119621 | 5/1993 |
| JP | 09-319202 | 12/1997 |
| JP | 2006308740 A * | 11/2006 |

OTHER PUBLICATIONS

Computer Translation of JP 2006308740 A.*

* cited by examiner

*Primary Examiner*—Quana M Grainger
(74) *Attorney, Agent, or Firm*—Banner & Witcoff, Ltd

(57) ABSTRACT

A developing device includes a cabinet, a developer carrier, a transport member rotating around a transport member shaft, and a developer cartridge attachable to and detachable from the cabinet. The developer cartridge includes a cartridge side first opening and a cartridge side second opening. The cabinet includes a cabinet side first opening located in a position opposed to the cartridge side first opening and a cabinet side second opening located in a position opposed to the cartridge side second opening. The cartridge side first opening, the cartridge side second opening, the cabinet side first opening and the cabinet side second opening extend in a vertical direction. The transport member transports a developer from the cabinet side first opening to the cabinet side second opening. A lower end of the cabinet side second opening is located upper than a center of the transport member shaft in the vertical direction.

9 Claims, 11 Drawing Sheets

DEVELOPING DEVICE WITH DETACHABLE TONER CARTRIDGE AND IMAGE FORMING APPARATUS HAVING THE SAME

CROSS-REFERENCE TO RELATED APPLICATIONS

This application claims priority from Japanese Patent Application No. 2007-051423 filed on Mar. 1, 2007, the entire subject matter of which is incorporated herein by reference.

TECHNICAL FIELD

Aspects of the present invention relate to an image forming apparatus, and a developing device detachably attached to the image forming apparatus.

BACKGROUND

There has been proposed an image forming apparatus such as a laser printer that includes a developing device for circulating developer between a toner cartridge for accommodating the developer and a frame to which the toner cartridge is detachably attached.

For example, JP-A-9-319202 discloses a developing device including a toner cartridge and a frame, in which a toner supply port for mutually communicating the inside of the frame to the inside of the toner cartridge is formed in a position corresponding to substantially center of the toner cartridge, and a pair of toner suction ports are formed in both sides of the toner supply port.

The developing device includes a developing roller, and an auger roller for rotating around a shaft extending along a longitudinal direction of the developing roller.

In this developing device, toner inside of the toner cartridge is supplied to the auger roller through the toner supply port, and the toner is supplied to the side of the developing roller while the toner being transported toward both ends in a direction (i.e., longitudinal direction of the developing roller) of the shaft by the auger roller. Then, the toner which has not been supplied to the side of the developing roller is circulated between the toner cartridge and the frame by being returned from each of the toner suction ports to the toner cartridge.

In this developing device disclosed in JP-A-9-319202, each of the toner suction ports is arranged between both ends of the shaft direction of the auger roller. Thus, the toner supplied from the toner supply port to the auger roller may be returned from each of the toner suction ports to the toner cartridge in the process of being transported to both ends of the shaft direction of the auger roller. In this case, the toner is not transported to both ends of the shaft direction of the auger roller. Thus, the toner may not be sufficiently supplied to both ends of the longitudinal direction of the developing roller.

SUMMARY

Aspects of the invention provide a developing device capable of sufficiently supplying developer to a developer carrier in a longitudinal direction, and an image forming apparatus to which the developing device is detachably attached.

DETAILED DESCRIPTION

General Overview

Figure 1:
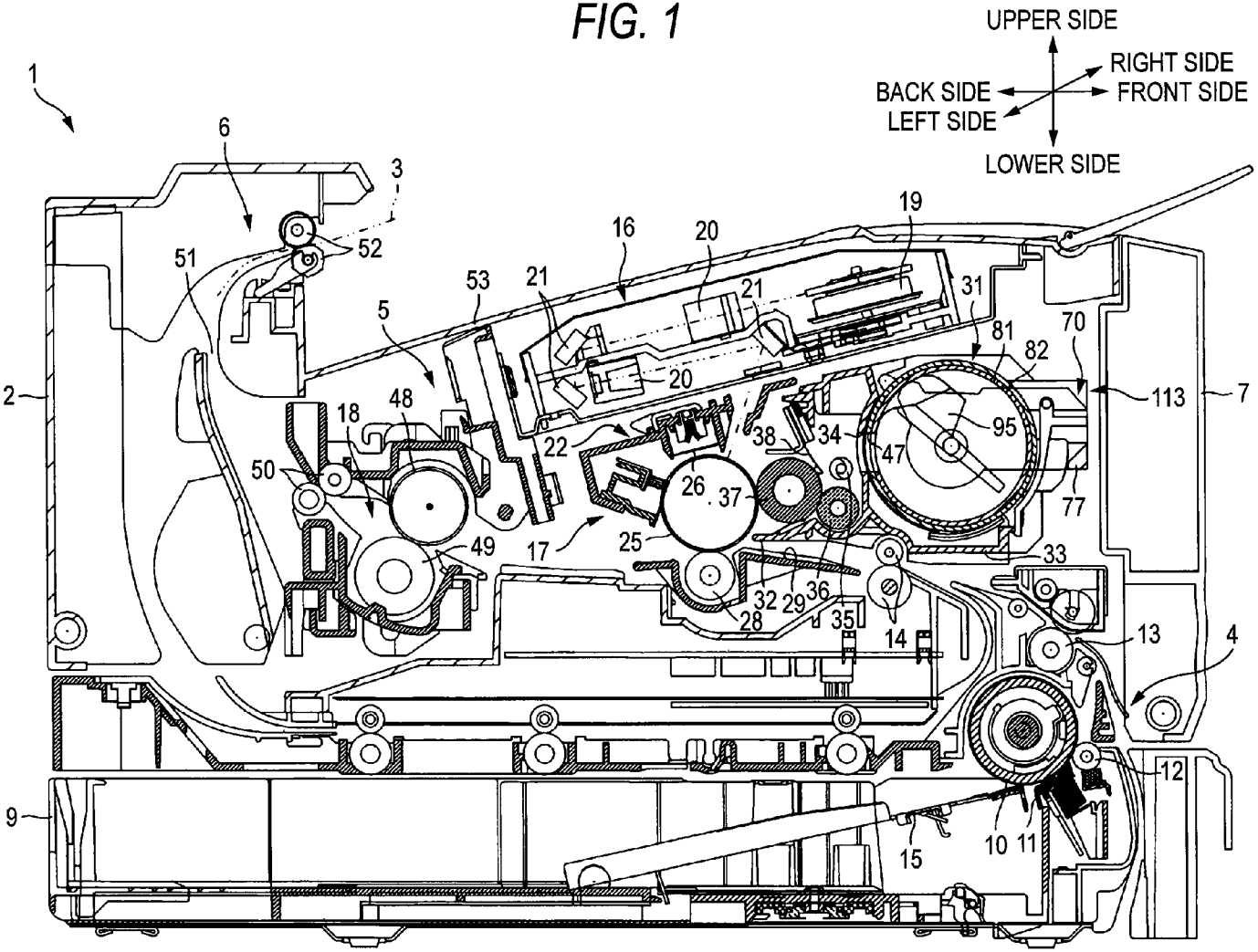
FIG. 1 is an exemplary side sectional view showing an image forming apparatus according to an aspect of the present invention.

According to an aspect of the present invention, there is provided a developing device including: a cabinet; a developer carrier that is supported in the cabinet and carries developer; a transport member that is supported in the cabinet and rotates around a transport member shaft and transports the developer to the developer carrier, the transport member shaft extending along a longitudinal direction of the developer carrier; and a developer cartridge that is attachable to and detachable from the cabinet and accommodates the developer, wherein: the developer cartridge includes: a cartridge side first opening that supplies the developer to the cabinet; and a cartridge side second opening that receives the developer from the cabinet; the cabinet includes: a cabinet side first opening that is located in a position opposed to the cartridge side first opening and receives the developer from the cartridge side first opening; and a cabinet side second opening that is located in a position opposed to the cartridge side second opening and supplies the developer to the cartridge side second opening; each of the cartridge side first opening, the cartridge side second opening, the cabinet side first opening and the cabinet side second opening extends in a substantially vertical direction; the transport member transports the developer from the cabinet side first opening to the cabinet side second opening; and a lower end of the cabinet side second opening is located in a position upper than a center of the transport member shaft in a vertical direction.

According to another aspect of the present invention, there is provided an image forming apparatus including: an image forming apparatus body; and a developing device that is attachable to and detachable from the image forming apparatus body, the developing device including: a cabinet; a developer carrier that is supported in the cabinet and carries developer; a transport member that is supported in the cabinet and rotates around a transport member shaft and transports the supplied developer to the developer carrier, the transport member shaft extending along a longitudinal direction of the developer carrier; and a developer cartridge that is attachable to and detachable from the cabinet and accommodates the developer, wherein: the developer cartridge includes: a cartridge side first opening that supplies the developer to the cabinet; and a cartridge side second opening that receives the developer from the cabinet; the cabinet includes: a cabinet side first opening that is located in a position opposed to the cartridge side first opening and receives the developer from the cartridge side first opening; and a cabinet side second opening that is located in a position opposed to the cartridge side second opening and supplies the developer to the cartridge side second opening; each of the cartridge side first opening, the cartridge side second opening, the cabinet side first opening and the cabinet side second opening extends in a substantially vertical direction; the transport member transports the developer from the cabinet side first opening to the cabinet side second opening; and a lower end of the cabinet side second opening is located in a position upper than a center of the transport member shaft in a vertical direction.

<Illustrative Aspects>

Illustrative aspects of the invention will be described with reference to the drawings.

(Image Forming Apparatus)

Figure 2:
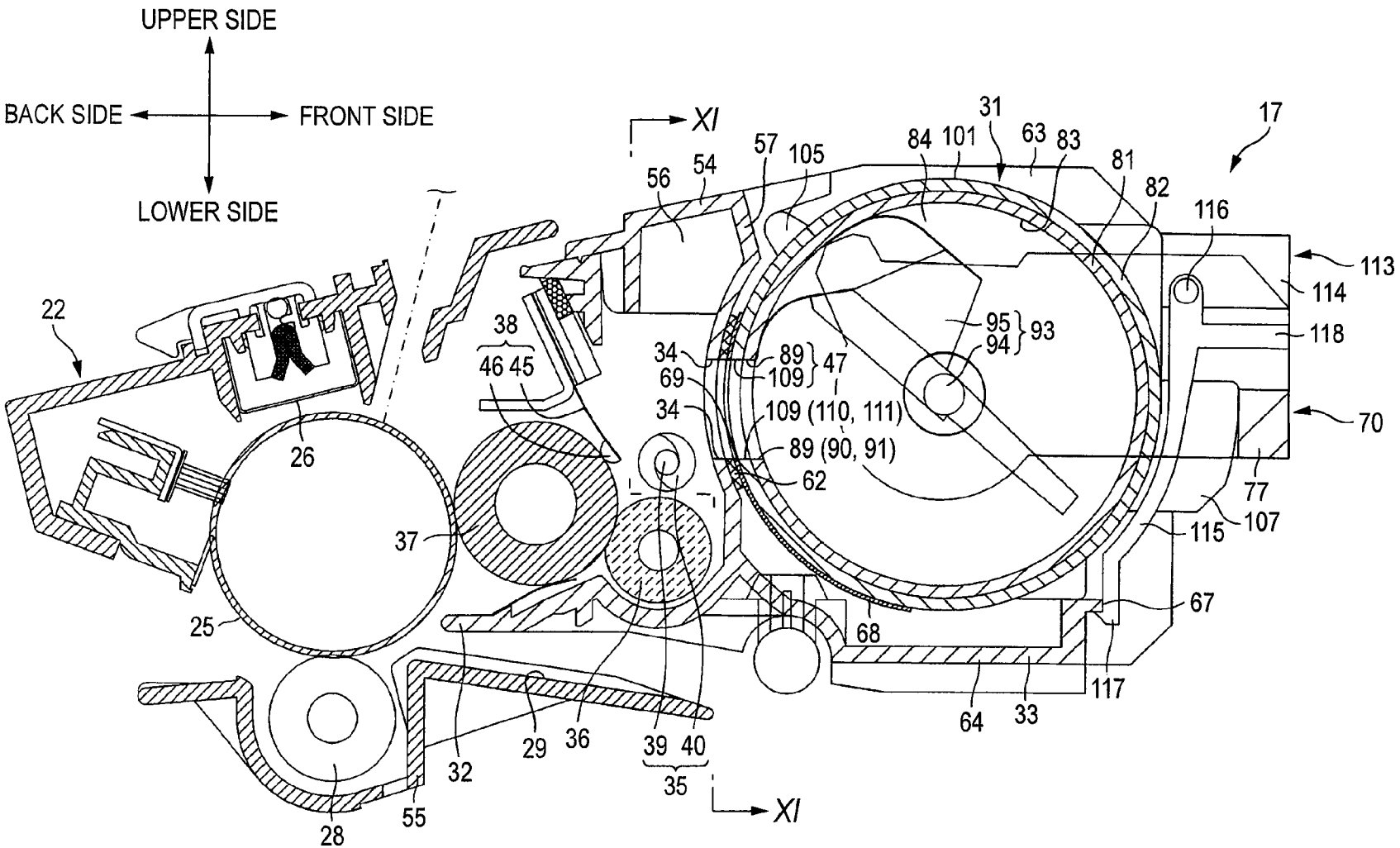
FIG. 2 is an exemplary side sectional view of a developing device and a developer cartridge in which the developer cartridge is attached to the developing device.

FIG. 1 is an exemplary side sectional view showing an image forming apparatus according to an aspect of the present invention. FIG. 2 is an exemplary side sectional view of a developing device and a developer cartridge in which the developer cartridge is attached to the developing device.

The image forming apparatus 1 includes a feeder unit 4 for feeding a sheet 3 to the inside of a body casing 2 as one example of an image forming apparatus body, an image forming unit 5 for forming an image on the fed sheet 3, and a sheet delivery part 6 for delivering the sheet 3 on which the image is formed as shown in FIG. 1.

(1) Body Casing

The body casing 2 has a substantially box shape, and an opening is formed in a sidewall of one side of the body casing 2, and a front cover 7 for opening and closing an opening is disposed. By opening the front cover 7, a developing device 17 (described below) can be attached to and detached from the body casing 2.

In addition, in the following description, the side in which the front cover 7 is disposed is referred to as a front side (front face side) and the opposite side is referred to as a back side (rear side). The front side of a sheet thickness direction in FIG. 1 is referred to as a left side, and the back side of the sheet thickness direction in FIG. 1 is referred to as a right side. Incidentally, left and right directions are synonymous with a width direction. Further, in the following description related to a developing device 17 and a developer cartridge 31, a state in which a frame side passage port 34 and a cartridge side passage port 47 described below face in a horizontal direction is used as the reference.

(2) Feeder Unit

The feeder unit 4 includes a sheet feeding tray 9, a sheet feeding roller 10, a sheet feeding pad 11, sheet powder removal rollers 12 and 13, register rollers 14, and a sheet press plate 15. Then, the uppermost sheet 3 of the sheet press plate 15 is fed out one at a time by the sheet feeding roller 10 and the sheet feeding pad 11 and passes through various rollers 12 to 14 and thereafter, is conveyed to a transfer position (described below) of the image forming unit 5.

(3) Image Forming Unit

The image forming unit 5 includes a scanner unit 16, the developing device 17, and a fixing part 18. In FIG. 1, the developing device 17 is embodied in the form of a process cartridge by way of an example. However, one of ordinary skill in the art will appreciate that the present inventive concept will apply equally to any unit which may be used for developing.

(3-1) Scanner Unit

The scanner unit 16 is arranged in an upper part of the inside of the body casing 2, and includes a laser light emitting part (not shown), a polygon mirror 19 rotated and driven, plural lenses 20 and plural reflecting mirrors 21. A laser beam based on image data emitted from the laser light emitting part is reflected by the polygon mirror 19 and passes through or is reflected by the plural lenses 20 and the plural reflecting mirrors 21 and is scanned to a surface of a photoconductive drum 25 (described below) of the developing device 17 as shown by a chain line.

(3-2) Developing Device

The developing device 17 is arranged under the scanner unit 16 in the inside of the body casing 2 and is detachably attached to the body casing 2.

As shown in FIG. 2, the developing device 17 includes a process frame 22 as one example of a cabinet in which a transfer path 29 for permitting passage of the sheet 3 is formed, and the developer cartridge 31 detachably attached to a cartridge receiving part 33 of the process frame 22.

In the process frame 22, a partition wall 57 extending in upper and lower directions is disposed in substantially the center position in front and back directions of the process frame 22, and the back side portion of the partition wall 57 forms a developing part 32 and the front side portion of the partition wall 57 forms the cartridge receiving part 33 described above. The frame side passage port 34 is formed in the partition wall 57.

The photoconductive drum 25 as one example of a photosensitive member, a scorotron-type charger 26, a transfer roller 28, a transport member 35, a supply roller 36, a developing roller 37 as one example of a developer carrier, and a layer thickness regulating blade 38 are mounted inside the developing part 32. In FIG. 2, the transport member 29 is embodied in the form of an auger by way of example. However, one of ordinary skill in the art will appreciate that other structures are possible for transferring the developer.

The photoconductive drum 25 is rotatably supported in the process frame 22. The scorotron-type charger 26 is supported in the process frame 22 over the photoconductive drum 25 in a state spaced from the photoconductive drum 25. The transfer roller 28 is arranged as opposed to the photoconductive drum 25 from the lower side of the photoconductive drum 25 and is rotatably supported in the process frame 22. The developing roller 37 is longitudinal in the width direction and is arranged as opposed to the front side of the photoconductive drum 25. The supply roller 36 is arranged as opposed to the front side of the developing roller 37. The developing roller 37 and the supply roller 36 are rotatably supported in the process frame 22. The layer thickness regulating blade 38 includes a leaf spring member 45 having a substantially thin plate shape, and a pressure contact rubber 46 disposed in the lower end of a leaf spring member 45. The upper end of the leaf spring member 45 is fixed to the process frame 22, and the pressure contact rubber 46 presses a surface of the developing roller 37 by elastic force of the leaf spring member 45. The transport member 35 is arranged as opposed to the frame side passage port 34 in the back side of the frame side passage port 34. The transport member 35 includes a transport member shaft 39 which is a shaft of the transport member 35, and a screw 40 disposed around the transport member shaft 39. The transport member shaft 39 is arranged so that a center portion of the transport member shaft 39 extends along the width direction, and is rotatably supported in the process frame 22 over the supply roller 36.

The developer cartridge 31 is detachably attached to the process frame 22 in the cartridge receiving part 33. The developer cartridge 31 has a substantially cylindrical shape. A cartridge side passage port 47 (described below) for communicating the inside to the outside is formed in the developer cartridge 31.

An agitator 93 (described below) is disposed inside the developer cartridge 31 for accommodating developer inside the developer cartridge 31. In the image forming apparatus 1 of the aspect, the developer includes nonmagnetic one-component toner with positive electrification.

The developer accommodated inside of the developer cartridge 31 is agitated by rotation of the agitator 93 and is received from the cartridge side passage port 47 to the frame side passage port 34 and is discharged to the inside of the developing part 32. The discharged developer is supplied to the supply roller 36 while being transported from the center of the width direction to both sides of the width direction by rotation of the transport member 35. Also, a part of the developer is returned to the inside of the developer cartridge 31 through the frame side passage port 34 and the cartridge side passage port 47. Consequently, circulation of the developer between the developer cartridge 31 and the developing part 32 of the process frame 22 is ensured.

The developer supplied to the supply roller 36 is supplied to the developing roller 37 by rotation of the supply roller 36. At this time, the developer is frictionally electrified in positive polarity between the supply roller 36 and the developing roller 37. Subsequently, the developer supplied to the developing roller 37 is carried as a thin layer on a surface of the developing roller 37 while with rotation of the developing roller 37, the developer enters between the pressure contact rubber 46 and the developing roller 37 and a layer thickness of the developer is regulated between the pressure contact rubber 46 and the developing roller 37.

Then, after a surface of the photoconductive drum 25 is first positively electrified uniformly by the scorotron-type charger 26 with rotation of the photoconductive drum 25, the surface is exposed by a laser beam from the scanner unit 16 and an electrostatic latent image based on image data is formed. When the developer carried on a surface of the developing roller 37 oppositely makes contact with the photoconductive drum 25 by rotation of the developing roller 37, the developer is carried to the electrostatic latent image formed on the surface of the photoconductive drum 25. Consequently, the electrostatic latent image is developed (imaged) and a developer image is carried on the surface of the photoconductive drum 25. The developer image is transferred to the sheet 3 conveyed between the photoconductive drum 25 and the transfer roller 28 (a transfer position) in the transfer path 29.

(3-3) Fixing Part

The fixing part 18 is disposed at the back of the developing device 17 as shown in FIG. 1. The fixing part 18 includes a heating roller 48, a pressurizing roller 49 brought into pressure contact with the heating roller 48 from the lower side, and a pair of conveying rollers 50 arranged in the back side of their rollers.

In the fixing part 18, the developer transferred to the sheet 3 in the transfer position is thermally fixed while the sheet 3 passes between the heating roller 48 and the pressurizing roller 49 and thereafter, the sheet 3 is conveyed to the sheet discharge part 6 by the pair of conveying rollers (4) Sheet Discharge Part The sheet discharge part 6 includes a sheet discharge path 51, sheet delivery rollers 52, and a sheet delivery tray 53. The sheet 3 conveyed from the fixing part 18 to the sheet discharge path 51 is conveyed from the sheet discharge path 51 to the sheet delivery rollers 52 and is delivered on the sheet delivery tray 53 by the sheet delivery rollers 52.

(Developing Device)

Figure 3:
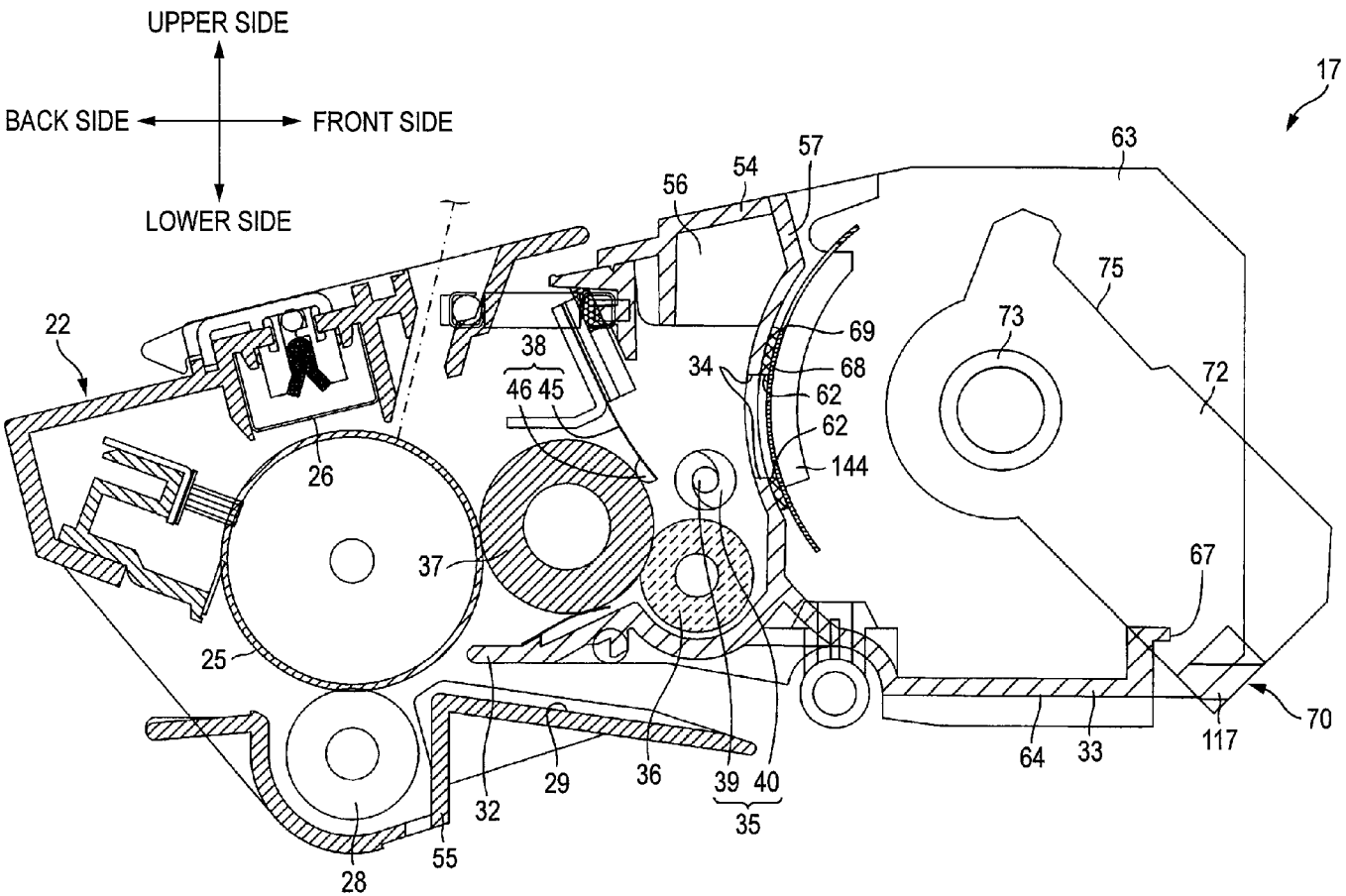
FIG. 3 is an exemplary side sectional view of the developing device in which the developer cartridge is detached from the developing device.
Figure 4:
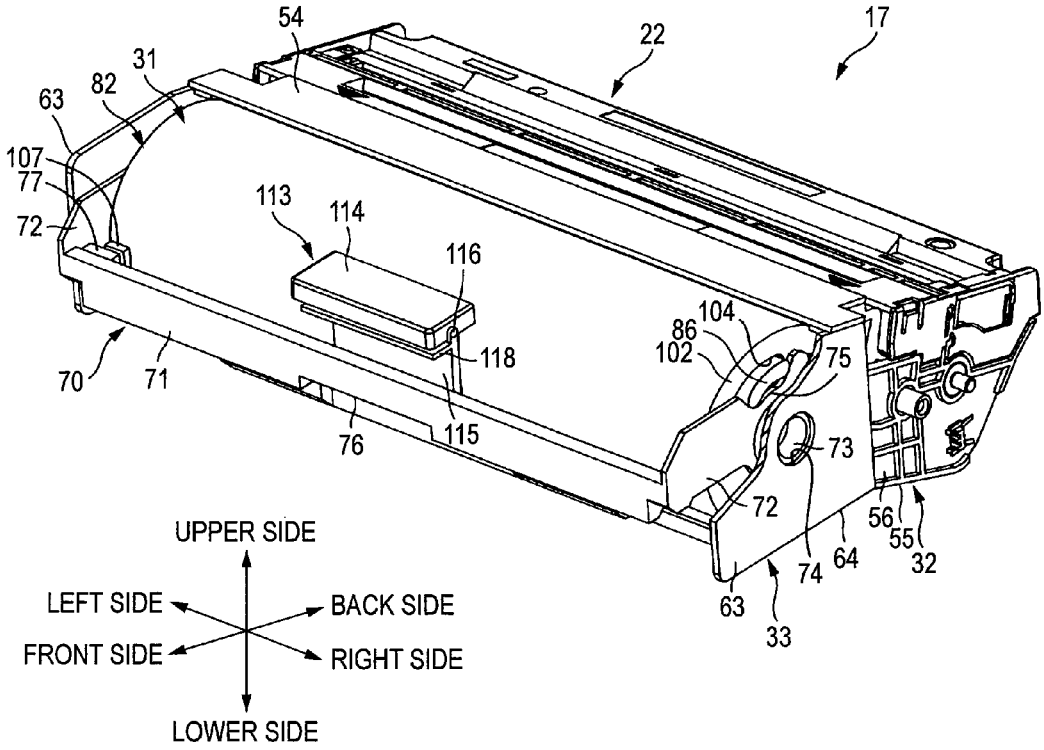
FIG. 4 is a schematic perspective view of the developing device as viewed from a diagonal front right side.
Figure 5:
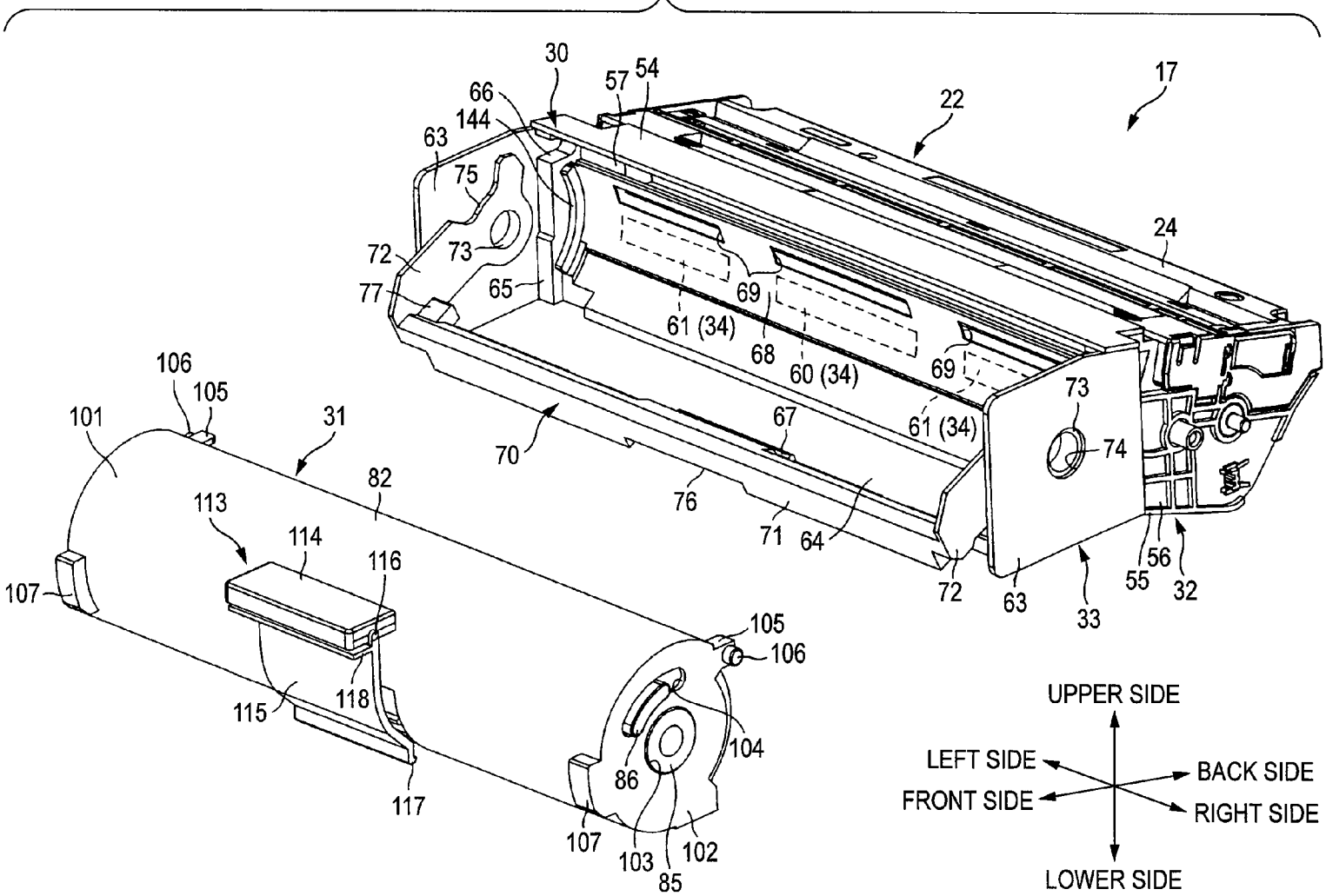
FIG. 5 is a schematic perspective view of the developing device as viewed from the diagonal front right side, in a state in which the developer cartridge is detached from the developing device.
Figure 6:
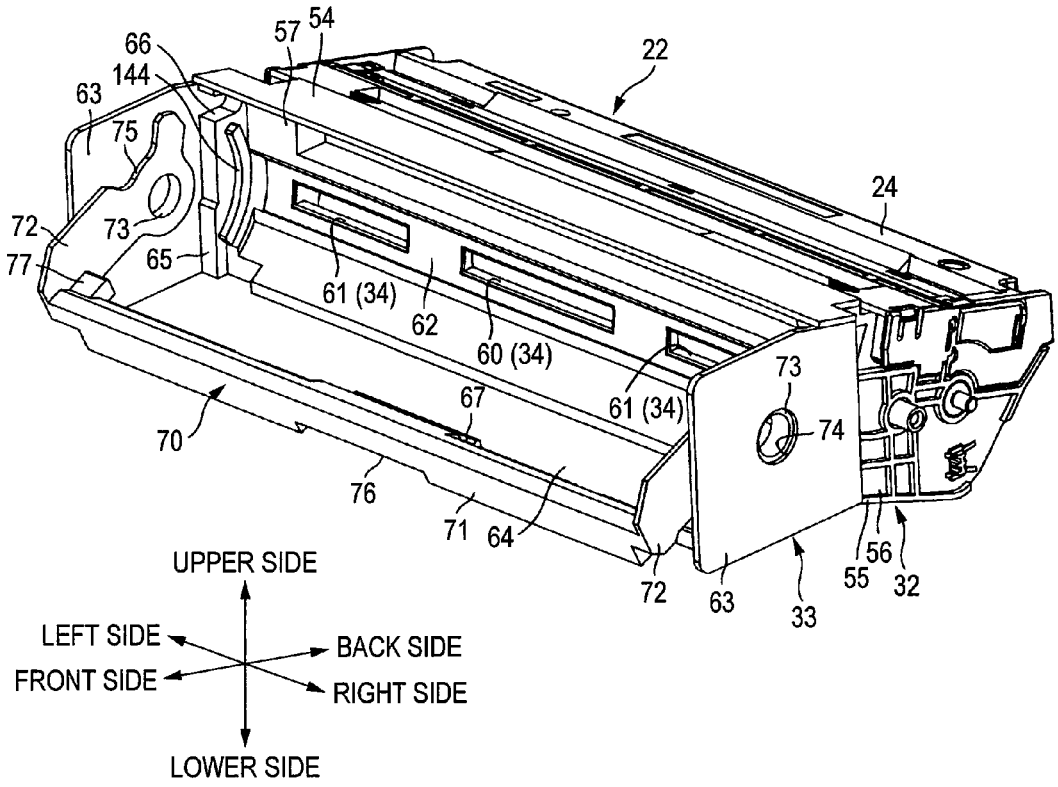
FIG. 6 is a schematic perspective view of the developing device in which a shutter is omitted in FIG. 5.
Figure 7:
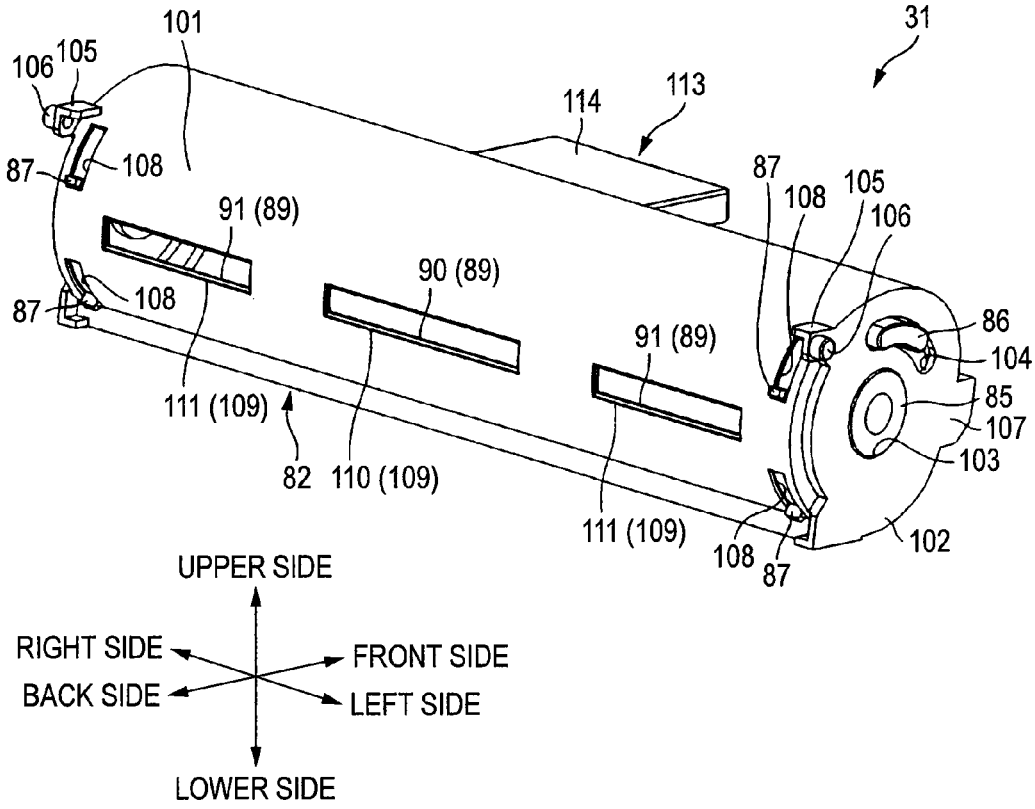
FIG. 7 is an exemplary perspective view of the developer cartridge, as viewed from a diagonal back left side, in a state in which an inside cabinet is in an opened position.
Figure 8:
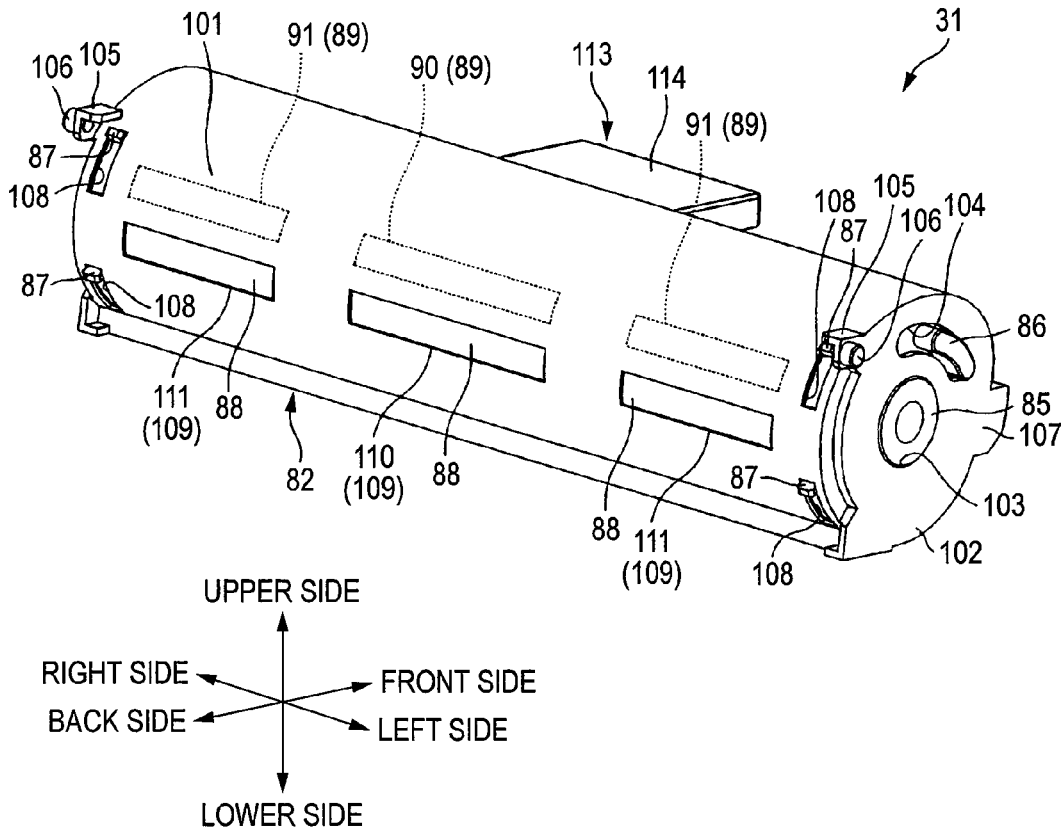
FIG. 8 is an exemplary perspective view of the developer cartridge, as viewed from the diagonal back left side, in a state in which the inside cabinet is in a closed position.
Figure 9:
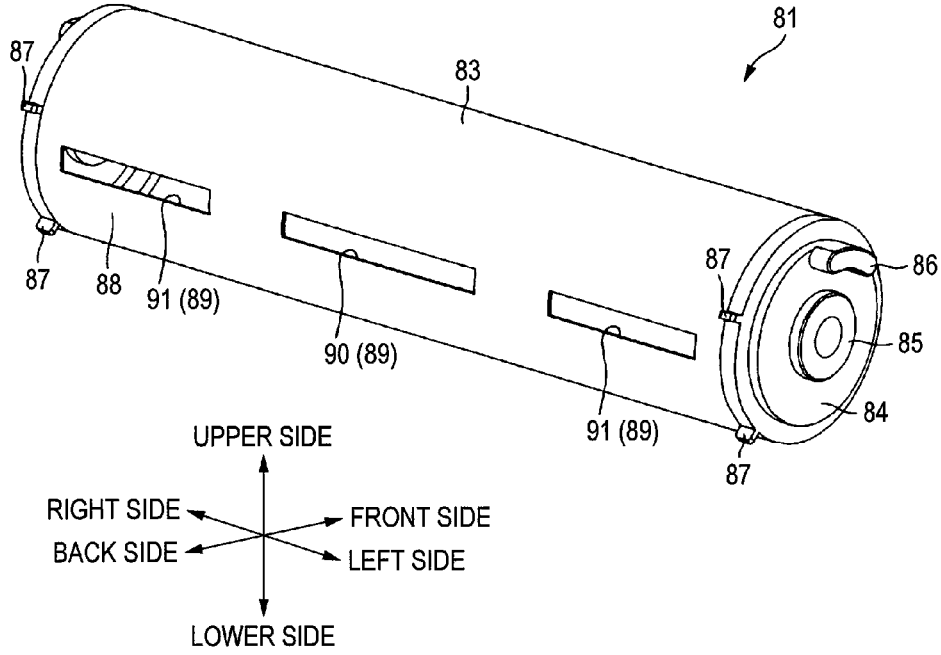
FIG. 9 is an exemplary perspective view of the inside cabinet as viewed from the diagonal back left side of the developer cartridge shown in FIG. 8.
Figure 10:
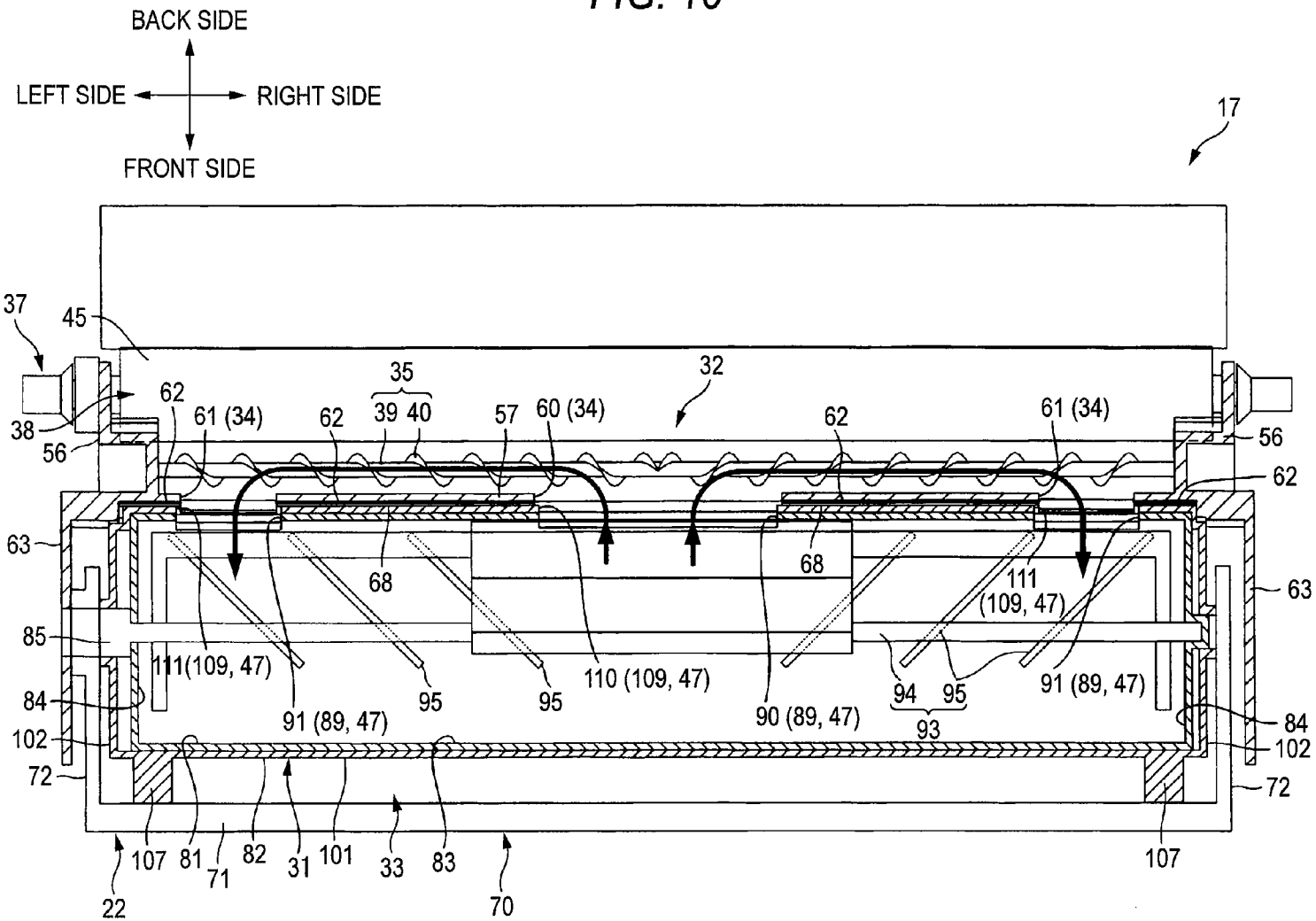
FIG. 10 is an exemplary plan sectional view of the developing device.
Figure 11:
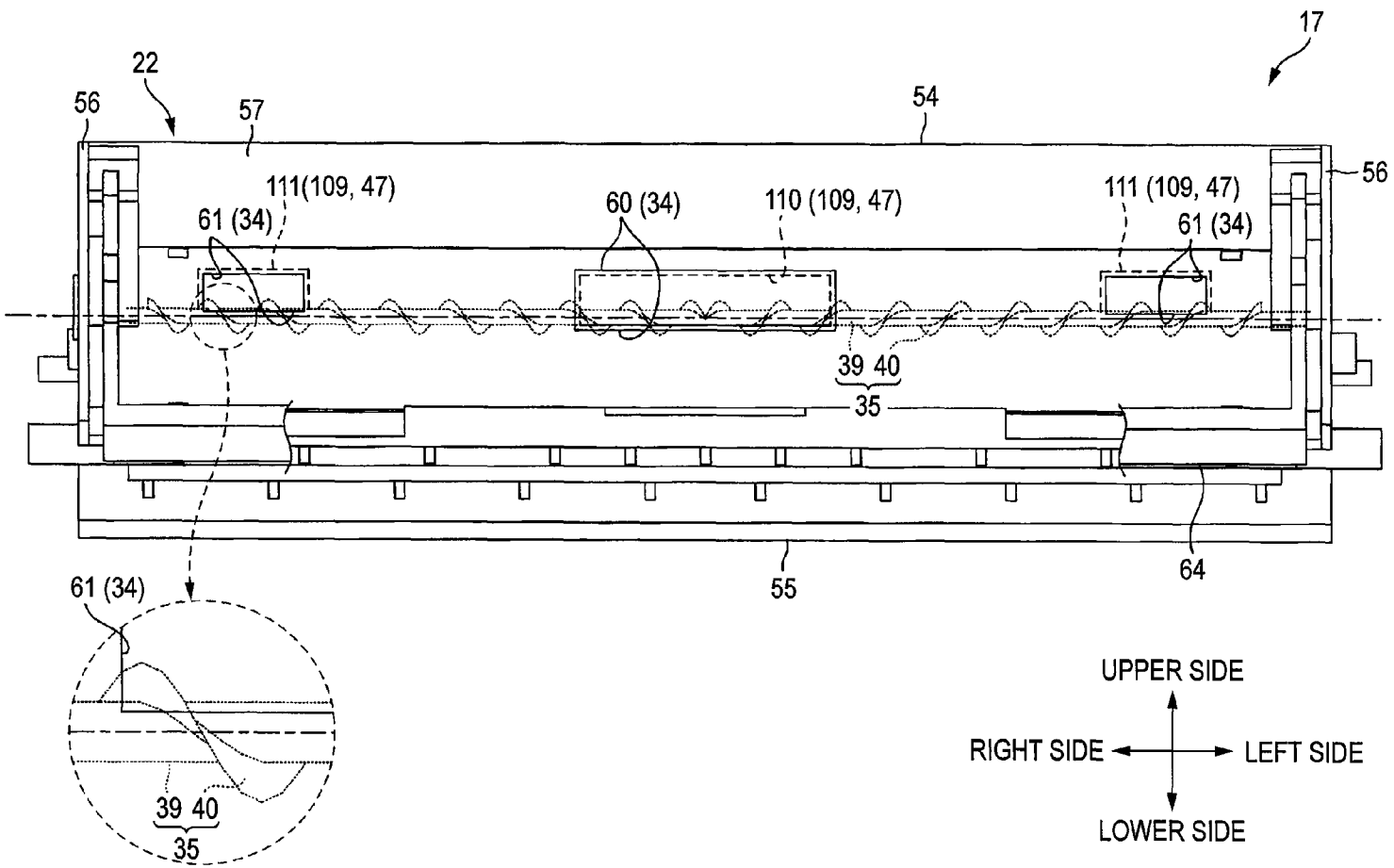
FIG. 11 is an exemplary cross-sectional view taken on an arrow XI-XI of FIG. 2.

FIG. 3 is an exemplary side sectional view of the developing device in which the developer cartridge is detached from the developing device. FIG. 4 is a schematic perspective view of the developing device as viewed from a diagonal front right side. FIG. 5 is a schematic perspective view of the developing device as viewed from the diagonal front right side, in a state in which the developer cartridge is detached from the developing device. FIG. 6 is a schematic perspective view of the developing device in which a shutter is omitted in FIG. 5. FIG. 7 is an exemplary perspective view of the developer cartridge, as viewed from a diagonal back left side, in a state in which an inside cabinet is in an opened position. FIG. 8 is an exemplary perspective view of the developer cartridge, as viewed from the diagonal back left side, in a state in which the inside cabinet is in a closed position. FIG. 9 is an exemplary perspective view of the inside cabinet as viewed from the diagonal back left side of the developer cartridge shown in FIG. 8. FIG. 10 is an exemplary plan sectional view of the developing device. FIG. 11 is an exemplary cross-sectional view taken on an arrow XI-XI of FIG. 2.

(1) Process Frame

The process frame 22 integrally includes the developing part 32 and the cartridge receiving part 33 as described above as shown in FIGS. 3 and 5.

(1-1) Developing Part

The developing part 32 integrally includes an upper wall 54, a bottom wall 55, both side walls 56 and the partition wall 57. Both the side walls 56 are arranged as opposed to each other at a spacing in the width direction. Each of the side walls 56 is arranged along the front and back directions.

The developing roller 37 is supported in the process frame 22 by being rotatably supported in the front side of both the side walls 56.

Also, the supply roller 36 is supported in the process frame 22 by being rotatably supported in the front side of both the side walls 56 in the front side of the developing roller 37.

Also, the transport member 35 is supported in the process frame 22 by rotatably supporting the transport member shaft 39 in the front side of both the side walls 56 in the upper side of the supply roller 36.

Also, in the partition wall 57, a curved portion along an outer peripheral surface of the developer cartridge 31 is formed in the middle of the upper and lower directions as shown in FIG. 3.

The frame side passage ports 34 described above are formed in the curved portion of the partition wall 57 as shown in FIG. 6.

Concretely, three frame side passage ports 34 are formed at a spacing in the width direction. Each of the frame side passage ports 34 has a substantially rectangular shape elongated in the width direction. The frame side passage port 34 formed in the center of the width direction of the partition wall 57 among the frame side passage ports 34 is used as a frame side supply port 60 as one example of a cabinet side first opening and the frame side passage ports 34 of both sides of the width direction of the frame side supply port 60 are used as frame side return ports 61 as one example of cabinet side second openings.

As shown in FIG. 11, the frame side supply port 60 and the frame side return ports 61 are arranged in line in the width direction. Also, in a vertical direction, the lower ends of the frame side return ports 61 are positioned in the side upper than the lower end of the frame side supply port 60 and the side upper than a center of the transport member shaft (a center line shown by a chain line in the transport member shaft 39) of the transport member 35 (also see an enlarged view).

Also, the outside ends of the width direction of the frame side return ports 61 are arranged in positions corresponding to both end portions of the width direction of the transport member 35 and the inside of the width direction (center side of the width direction) from the outside ends of the width direction of a roller portion of the supply roller 36.

Also, a frame side seal 62 for preventing leakage of developer from the frame side passage ports 34 in the peripheral edges of the frame side passage ports 34 is disposed in the curved portion of the partition wall 57 as shown in FIG. 6.

The frame side seal 62 is formed from an elastic material such as felt having a substantially band shape extending in the width direction, and a notched portion is formed in correspondence with each of the frame side passage ports 34. The frame side seal 62 is pasted along the width direction so that each of the notched portions is opposed to each of the frame side passage ports 34 in the middle of the upper and lower directions of the partition wall 57.

Consequently, the frame side seal 62 is disposed on a surface (front) of the curved portion of the partition wall 57 so as to coat the peripheral edge of each of the frame side passage ports 34 and continue between each of the frame side passage ports 34.

(1-2) Cartridge Receiving Part

The cartridge receiving part 33 includes both side plates 63 and a bottom plate 64 as shown in FIG. 5. Both the side plates 63 and the bottom plate 64 of the cartridge receiving part 33 are integrally formed continuously with both the side walls 56 and the bottom wall 55 of the developing part 32.

Shutter support parts 65 are disposed on inside surfaces of the width direction of both the side plates 63. The shutter support part 65 has a substantially rectangular shape inward bulging from an inside surface of the width direction of both the side plates 63 and is disposed so as to extend in the upper and lower directions in the back end portions of both the side plates 63.

A shutter guide part 144 is disposed on an inside surface of the width direction of each of the shutter support parts 65. Each of the shutter guide parts 144 forms a protrusion stripe inward bulging from the inside surface of the width direction of the shutter support part 65, and is arranged as opposed to the curved portion of the partition wall 57 at a slight spacing in the front and back directions. Each of the shutter guide parts 144 has a substantially curved shape with substantially the same curvature as that of the curved portion of the partition wall 57.

Also, an upper end surface of each of the shutter support parts 65 is arranged in a position slightly lower than the upper edge of each of the side plates 63. The upper end surface of each of the shutter support parts 65 forms an upper side fixed part 66.

Also, in the bottom plate 64, a lower side fixed part 67 slightly protruding to the front side is formed in the center of the width direction of the front edge.

Also, a shutter 68 for opening and closing the frame side passage ports 34 is disposed in the cartridge receiving part 33.

The shutter 68 has a substantially rectangular shape extending in the width direction and has a substantially curved shape with substantially the same curvature as that of the curved portion of the partition wall 57. The shutter 68 is formed so as to extend between each of the shutter guide parts 144 in the width direction and extend slightly shorter than each of the shutter guide parts 144 in the upper and lower directions. Also, three shutter opening parts 69 capable of being opposed to the frame side passage ports 34 corresponding to each of the frame side passage ports 34 are formed in the shutter 68.

The shutter 68 is arranged as opposed to the curved portion of the partition wall 57, and both end portions of a width direction of the shutter 68 are slidably pinched between the partition wall 57 and each of the shutter guide parts 144 (see FIG. 3).

Consequently, the shutter 68 is supported slidably along the each of the shutter guide parts 144 in the upper and lower directions between an opened position (see FIG. 2) in which the frame side passage ports 34 are opened and a closed position (see FIGS. 3 and 5) in which the frame side passage ports 34 are closed. When the shutter 68 is in the opened position, each of the frame side passage ports 34 is opposed to the corresponding shutter opening parts 69 and is opened to the outside (front side). When the shutter 68 is in the closed position, each of the frame side passage ports 34 is closed from the front side by the portions of the lower sides than the shutter opening parts 69 in the shutter 68.

Also, a swing arm 70 is disposed in the cartridge receiving part 33. The swing arm 70 has a substantially U shape as viewed from the plane. The swing arm 70 integrally includes a grasp bar 71 extending in the width direction, and arm side plates 72 backward extending from both end portions of the width direction of the grasp bar 71.

A boss 73 outward protruding in the width direction is disposed in the back end of each of the arm side plates 72. Each of the bosses 73 is rotatably supported in a circular hole 74 formed in each of the side plates 63.

Also, a receiving recessed part 75 notched so as to be recessed to the lower side is formed in the upper side edge of the back end of each of the arm side plates 72.

A grasp part 76 recessed to the upper side is formed in the center of the width direction of the grasp bar 71. Also, press protrusion parts 77 are disposed in both end portions of the width direction of the grasp bar 71.

Using the boss 73 of each of the arm side plates 72 as a fulcrum, the swing arm 70 swings between a pressing release position (see FIGS. 3 and 5) in which the lower edge of each of the arm side plates 72 makes contact with the front edge of the bottom plate 64 and a pressing position (see FIGS. 2 and 4) in which the developer cartridge 31 is pressed from the front side when the developer cartridge 31 is received in the cartridge receiving part 33.

(2) Developer Cartridge

The developer cartridge 31 includes an inside cabinet 81 for accommodating developer, and an outside cabinet 82 for receiving the inside cabinet 81 as shown in FIGS. 7 to 9.

(2-1) Inside Cabinet

The inside cabinet 81 integrally includes a cylindrical inside peripheral wall 83 extending in the width direction, and inside side walls 84 each having a substantially circular plate shape for closing both end portions of the width direction of the inside peripheral wall 83 as shown in FIG. 9.

A boss part 85 having a substantially circular thick plate shape outward bulging in the width direction is disposed in the center of each of the inside side walls 84.

Also, a slide protrusion 86 is disposed in the radial outside from the boss part 85 and an upper side portion of each of the inside side walls 84. The slide protrusion 86 is formed in a substantially circular arc shape (circular arc shape with a center angle of about 60°) as viewed from the side along an outer peripheral surface of the inside side wall 84, and is disposed so as to protrude from the inside side wall 84 to the outside of the width direction.

Also, a pair of pinch protrusions 87 radially protruding from a peripheral end surface are disposed in a back side portion of each of the inside side walls 84. The pair of pinch protrusions 87 are arranged at a spacing (spacing corresponding to a circumferential length of the shutter 68) in a circumferential direction mutually in the peripheral end surface of each of the inside side walls 84.

In the inside peripheral wall 83, inside passage ports 89 for forming the cartridge side passage ports 47 are formed in a surrounded portion 88 surrounded by the pair of pinch protrusions 87 (four pinch protrusions 87) arranged in both sides of the width direction.

The inside passage ports 89 are formed in the upper side portion of the surrounded portion 88. Concretely, three inside passage ports 89 are formed at a spacing in the width direction. Each of the inside passage ports 89 has a substantially rectangular shape elongated in the width direction. The inside passage port 89 formed in the center of the width direction among the inside passage ports 89 is used as an inside supply port 90 as one example of a cartridge side first opening and the inside passage ports 89 of both sides of the width direction of the inside supply port 90 are used as inside return ports 91 as one example of cartridge side second openings.

As shown in FIG. 2, the agitator 93 described above is disposed inside the inside cabinet 81. The agitator 93 includes an agitator shaft 94 extending in the width direction which is a shaft of the agitator 93, and an agitating blade 95 as one example of an agitating member extending from the agitator shaft 94 to the radial outside. The agitator shaft 94 is rotatably supported in both the inside side walls 84, and rotates by driving force from a motor (not shown) at the time of forming an image. Consequently, the agitating blade 95 also rotates and the developer inside of the developer cartridge 31 is agitated as described above.

Here, in a state in which the inside cabinet 81 is in an opened position (described below), the lower end of the inside supply port 90 is positioned in the side lower than a center of the agitator shaft 94 of the agitator 93 in the vertical direction.

(2-2) Outside Cabinet

The outside cabinet 82 is formed slightly larger than the inside cabinet 81 in the width and radial directions in order to rotatably receive the inside cabinet 81. The outside cabinet 82 integrally includes an outside peripheral wall 101 having a substantially cylindrical shape extending in the width direction, and outside sidewalls 102 each having a substantially circular plate shape for closing both ends of the width direction of the outside peripheral wall 101 as shown in FIG. 8.

A circular boss hole 103 for receiving the boss part 85 is formed in each of the outside side walls 102. Also, a slide hole 104 into which the slide protrusion 86 is inserted is formed in an upper side portion of each of the outside side walls 102. The slide hole 104 is arranged as opposed to the slide protrusion 86 in the width direction. The slide hole 104 has a substantially circular arc shape with a circumferential length longer than that of the slide protrusion 86 as viewed from the side.

Also, a backward protruding upper side part 105 to be fixed is formed in the back side of a peripheral end surface of each of the outside side walls 102. A positioning boss 106 outward protruding in the width direction is disposed in the back end of the upper side part 105 to be fixed.

Also, a forward bulging pressed part 107 is disposed on the lower front side of the peripheral end surface of each of the outside side walls 102 as shown in FIG. 5. The pressed part 107 has a substantially rectangular shape as viewed from the front and a substantially circular arc shape extending from the front side of each of the outside side walls 102 to the lower side as viewed from the side.

Four elongated holes 108 into which the pair of pinch protrusions 87 (four pinch protrusions 87) are respectively inserted are formed in both end portions of the width direction in the outside peripheral wall 101 as shown in FIG. 8. Each of the elongated holes 108 is arranged as opposed to each of the pinch protrusions 87 in a radial direction. Each of the elongated holes 108 has a substantially rectangular shape extending in the upper and lower directions as viewed from the rear and is formed in a length corresponding to a swing range between the opened position and the closed position of the shutter 68 described above.

Also, in the outside peripheral wall 101, outside passage ports 109 for forming the cartridge side passage ports 47 are formed between the four elongated holes 108 (between the two elongated holes 108 of the upper side and the two elongated holes 108 of the lower side).

The three outside passage ports 109 are formed at a spacing in the width direction. Each of the outside passage ports 109 has a substantially rectangular shape elongated in the width direction. A size of each of the outside passage ports 109 is substantially equal to a size of each of the inside passage ports 89. The outside passage port 109 formed in the center of the width direction among the outside passage ports 109 is used as an outside supply port 110 as one example of a cartridge side first opening and the outside passage ports 109 of both sides of the width direction of an outside supply port 110 are used as outside return ports 111 as one example of cartridge side second openings.

As shown in FIG. 11, the outside supply port 110 is opposed to the frame side supply port 60 and the two outside return ports 111 are opposed to the two frame side return ports 61 in a state of attaching the developer cartridge 31 to the process frame 22. Here, the outside supply port 110 is formed smaller than the frame side supply port 60. Also, the outside return ports 111 are formed larger than the frame side return ports 61.

Also, in the front side of the outside peripheral wall 101, a grip part 113 is disposed in the center of the width direction as shown in FIG. 5.

The grip part 113 includes an upper grasp plate 114 having a substantially rectangular shape forward protruding from the outside peripheral wall 101, and a locking arm 115 having a substantially J shape as viewed from the side downward extending from the upper grasp plate 114. The upper end of the locking arm 115 is swingably supported in a support shaft 116 disposed in the upper grasp plate 114. A locking claw 117 for locking in the lower side fixed part 67 is disposed in the lower end of the locking arm 115. A lower grasp plate 118 having a substantially rectangular shape forward protruding is disposed in the vicinity of the upper end of the locking arm 115. The lower grasp plate 118 is arranged so as to extend in spaced parallel with the upper grasp plate 114.

A compression spring (not shown) for urging the grasp plates in a direction of separation is interposed between the upper grasp plate 114 and the lower grasp plate 118.

(2-3) Relative Arrangement of Inside Cabinet and Outside Cabinet

As shown in FIG. 2, the inside cabinet 81 is rotatably received inside the outside cabinet 82.

Concretely, an outer peripheral surface of the inside peripheral wall 83 is inward fitted slidably in a circumferential direction with respect to an inner peripheral surface of the outside peripheral wall 101. Also, outer peripheral surfaces of both the inside side walls 84 are inward fitted slidably in a circumferential direction with respect to inner peripheral surfaces of both the outside side walls 102 (not shown). As shown in FIGS. 7 and 8, the boss part 85 is rotatably supported in the boss hole 103. The slide protrusion 86 is inserted into the slide hole 104. Each of the pinch protrusions 87 is inserted into each of the elongated holes 108, and each of the pinch protrusions 87 is protruded from each of the elongated holes 108 to the outside of a radial direction.

The inside cabinet 81 permits relative rotates using the boss part 85 as a fulcrum between a closed position (see FIG. 8) in which the inside passage ports 89 are not opposed to the outside passage ports 109 and an opened position (see FIG. 7) in which the inside passage ports 89 are opposed to the outside passage ports 109 with respect to the outside cabinet 82.

When the inside cabinet 81 is arranged in the closed position, as shown in FIG. 8, each of the slide protrusions 86 is arranged in the front end of each of the slide holes 104, and each of the pinch protrusions 87 is arranged in the upper end of each of the elongated holes 108, and the inside passage ports 89 are arranged in the side upper than the outside passage ports 109, and the outside passage ports 109 are closed by the lower side portion of the surrounded portion 88.

Then, the inside cabinet 81 is relatively rotated in a direction (lower side) in which the inside passage ports 89 move toward the outside passage ports 109 with respect to the outside cabinet 82 using the boss part 85 as a fulcrum. Then, each of the slide protrusions 86 slides each of the slide holes 104 from the front end toward the back end, and each of the pinch protrusions 87 slides each of the elongated holes 108 from the upper end toward the lower end.

Thereafter, when each of the slide protrusions 86 abuts on the back edge of each of the slide holes 104 and each of the pinch protrusions 87 abuts on the lower edge of each of the elongated holes 108, the inside cabinet 81 is arranged in the opened position as shown in FIG. 7.

When the inside cabinet 81 is arranged in the opened position, each of the slide protrusions 86 is arranged in the back end of each of the slide holes 104, and each of the pinch protrusions 87 is arranged in the lower end of each of the elongated holes 108, and the inside passage ports 89 are opposed to the outside passage ports 109 and these passage ports are communicated and opened.

In addition, when the inside cabinet 81 is relatively rotated in a direction in which the inside passage ports 89 rise from the outside passage ports 109 with respect to the outside cabinet 82 using the boss part 85 as the fulcrum, each of the slide protrusions 86 abuts on the front edge of each of the slide holes 104 and each of the pinch protrusions 87 abuts on the upper edge of each of the elongated holes 108 and the inside cabinet 81 is arranged in the closed position as shown in FIG. 8.

(3) Attachment and Detachment of Developer Cartridge to and from Process Frame (3-1) Attachment of Developer Cartridge to Process Frame When the developer cartridge 31 is attached to the process frame 22, the upper grasp plate 114 and the lower grasp plate 118 of the grip part 113 are first pinched in a direction in which their grasp plates move near as shown in FIG. 5. Then, the developer cartridge 31 (the inside cabinet 81 is arranged in a closed position) is attached to the cartridge receiving part 33 (the shutter 68 is arranged in the closed position and the swing arm 70 is arranged in a pressing release position).

At this time, each of the positioning bosses 106 is placed on each of the upper side fixed parts 66 and a pair of the pinch protrusions 87 (see FIGS. 7 and 8) of both sides of the width direction respectively pinch the upper edge and the lower edge of both end portions of the width direction of the shutter 68 and each of the slide protrusions 86 is fitted into each of the receiving recessed parts 75.

Thereafter, when the pinch of the grip part 113 is released, the locking claw 117 is locked in the lower side fixed part 67 and the developer cartridge 31 is received in the cartridge receiving part 33 as shown in FIG. 2.

The outside cabinet 82 is fixed to the cartridge receiving part 33 since the positioning bosses 106 are placed to the upper side fixed parts 66 (see FIG. 5) and the locking claw 117 is locked to the lower side fixed part 67. Consequently, attachment of the developer cartridge 31 to the process frame 22 is completed.

Then, the swing arm 70 is swung from the pressing release position to a pressing position. Then, each of the press protrusion parts 77 presses each of the pressed part 107 toward the back side as shown in FIGS. 2 and 4. Consequently, the developer cartridge 31 is pressed toward the developing part 32.

Also, when the swing arm 70 is swung from the pressing release position to the pressing position, with swing of each of the arm side plates 72, each of the slide protrusions 86 fitted into each of the receiving recessed parts 75 slides each of the slide holes 104 to the back side and is arranged in the back end of each of the slide holes 104. Further, with the shutter 68 pinched, a pair of the pinch protrusions 87 of both sides of the width direction slide each of the elongated holes 108 to the lower side and are arranged in the lower end of each of the elongated holes 108 (see FIG. 7).

Consequently, as shown in FIG. 2, the inside cabinet 81 is arranged in the opened position and the inside passage ports 89 are opposed to the outside passage ports 109 and these passage ports are communicated. Also, the shutter 68 is arranged in the opened position and the frame side passage ports 34 are opposed to the cartridge side passage ports 47 (the inside passage ports 89 and the outside passage ports 109) and these passage ports are communicated.

Then, at the time of forming an image, by agitation of the agitator 93, the developer inside of the inside cabinet 81 is supplied from the inside supply port 90 and the outside supply port 110 to the side of the developing part 32 and is received inside the developing part 32 in the frame side supply port 60 as shown by thick line arrows of FIG. 10.

In contrast, by the transport member 35, the developer supplied from the frame side supply port 60 to the inside of the developing part 32 is transported from the center of the width direction to both ends of the width direction and is supplied to the supply roller 36 on the way. The developer supplied to the supply roller 36 is supplied to the developing roller 37 as described above. The developer which has not been supplied to the supply roller 36 is transported to the frame side return ports 61 and passes through the outside return ports 111 and the inside return ports 91 and is returned from the developing part 32 to the inside of the inside cabinet 81. Consequently, the developer is circulated between the developing part 32 and the inside cabinet 81. In order to ensure circulation of the developer in a horizontal direction between the developing part 32 and the inside cabinet 81 at this time, the frame side passage ports 34 and the cartridge side passage ports 47 extend in a substantially vertical direction (a direction of, for example, 45 to 135°, preferably 80 to 100° with respect to a horizontal direction) (see FIG. 2).

(3-2) Detachment of Developer Cartridge from Process Frame

When the developer cartridge 31 is detached from the process frame 22, the swing arm 70 is first swung from the pressing position to the pressing release position (see FIGS. 3 and 5). Then, each of the press protrusion parts 77 is separated from each of the pressed part 107 and a press of the developer cartridge 31 on the developing part 32 is released.

Also, when the swing arm 70 is swung from the pressing position to the pressing release position, with swing of each of the arm side plates 72, each of the slide protrusions 86 fitted into each of the receiving recessed parts 75 slides each of the slide holes 104 to the front side and is arranged in the front end of each of the slide holes 104 as shown in FIG. 8. Further, with the shutter 68 pinched, a pair of the pinch protrusions 87 of both sides of the width direction slide each of the elongated holes 108 to the upper side and are arranged in the upper end of each of the elongated holes 108.

Consequently, the inside cabinet 81 is arranged in the closed position, and the lower side portion of the surrounded portion 88 is opposed to the outside passage ports 109, and the outside passage ports 109 are closed. Also, the shutter 68 is arranged in the closed position, and the frame side passage ports 34 are opposed to the shutter 68 and are closed.

Then, when the upper grasp plate 114 and the lower grasp plate 118 of the grip part 113 are pinched in a direction in which their grasp plates move near, locking of the locking claw 117 to the lower side fixed part 67 is released (see FIG. 2), so that when the developer cartridge 31 is pulled from the cartridge receiving part 33 to the front side as it is, the developer cartridge 31 is detached from the process frame 22 (see FIG. 5).

In the developing device 17, the developer accommodated in the developer cartridge 31 is received inside the process frame 22 (specifically, the developing part 32) through the inside supply port 90, the outside supply port 110 and the frame side supply port 60 as shown by thick line arrows of FIG. 10. The developer is transported to the frame side return ports 61 by the transport member 35 and then is received inside the developer cartridge 31 through the frame side return ports 61, the outside return ports 111 and the inside return ports 91. That is, in the developing device 17, the developer is circulated between the developer cartridge 31 and the process frame 22.

Also, by rotating around the transport member shaft 39 extending along a longitudinal direction (width direction) of the developing roller 37, the transport member 35 transports developer and supplies the developer to the developing roller 37 in the longitudinal direction (see FIG. 2).

Then, as shown in FIG. 11, the lower ends of the frame side return ports 61 are positioned in the side upper than the center (see a chain line illustrated) of the transport member shaft 39 in a vertical direction, so that the developer transported to the frame side return ports 61 by the transport member 35 becomes resistant to falling to the frame side return ports 61 and is subsequently transported by the transport member 35. Consequently, the developer can sufficiently be supplied to the developing roller 37 in the longitudinal direction.

Further, as shown in FIG. 2, the lower ends of the inside supply port 90 and the outside supply port 110 are positioned in the side lower than a center of the agitator shaft 94 of the agitator 93 in a vertical direction in a state in which the inside cabinet 81 is in an opened position. As a result, developer agitated by the agitator 93 inside the developer cartridge 31 tends to fall to the inside supply port 90 and the outside supply port 110, and the developer can surely be supplied to the process frame 22 through the inside supply port 90 and the outside supply port 110.

Further, as shown in FIG. 11, the lower ends of the frame side return ports 61 are positioned in the side upper than the lower end of the frame side supply port 60 in a vertical direction. As a result, developer supplied from the inside supply port 90 and the outside supply port 110 tends to be received in the frame side supply port 60.

In contrast, in the frame side return ports 61, developer transported from the frame side supply port 60 by the transport member 35 becomes resistant to falling, so that the developer is subsequently transported by the transport member 35. Consequently, the developer can sufficiently be supplied to the developing roller 37 in the longitudinal direction.

Also, the frame side supply port 60 and the frame side return ports 61 are arranged in line in the longitudinal direction (width direction) of the developing roller 37, so that the transport member 35 rotating around the transport member shaft 39 extending along the width direction can smoothly transport developer from the frame side supply port 60 to the frame side return ports 61.

Also, the frame side return ports 61 are arranged in both end portions of the width direction of the transport member 35. As a result, developer is transported to both end portions of the width direction of the transport member 35 and then reaches the frame side return ports 61, so that the developer can sufficiently be supplied to the developing roller 37 in the longitudinal direction (width direction).

Also, the frame side supply port 60 is larger than the opposed outside supply port 110, so that developer from the developer cartridge 31 supplied through the outside supply port 110 can surely be received in the frame side supply port 60.

Also, the outside return ports 111 are larger than the opposed frame side return ports 61, so that developer from the process frame 22 supplied through the frame side return ports 61 can surely be received in the outside return ports 111.

MODIFIED EXAMPLES

In the above-described aspects, the developing device 17 integrally includes the photoconductive drum 25 and the developing roller 37, and the developing device 17 is detachably attached to the body casing 2. Additionally, while a developing cartridge without including the photoconductive drum 25 is used as the developing device 17, another unit (i.e., drum cartridge) including the photoconductive drum 25 may be disposed and the developing cartridge may be detachably attached to the drum cartridge.

Further, the photoconductive drum 25, the scorotron-type charger 26 and the transfer roller 28 can also be disposed in the body casing 2 to detachably attach the developing cartridge to the body casing 2.

Still further, although aspects of the present inventive concept have been described in relation to a laser printer, the present inventive concept is not limited to a monochrome laser printer. Rather, the present inventive concept can also be applied to a color laser printer, including a tandem type and an intermediate transfer type printer.

What is claimed is:

1. A developing device comprising:

a cabinet;

a developer carrier that is supported in the cabinet and is configured to carry developer;

a transport member that is supported in the cabinet and is configured to rotate around a transport member shaft and transport the developer to the developer carrier, the transport member shaft extending along a longitudinal direction of the developer carrier; and a developer cartridge that is attachable to and detachable from the cabinet and accommodates the developer, wherein the developer cartridge includes:

a cartridge side first opening that is configured to supply the developer to the cabinet; and a cartridge side second opening that is configured to receiver the developer from the cabinet;

wherein the cabinet includes:

a cabinet side first opening that is located in a position opposed to the cartridge side first opening and is configured to receive the developer from the cartridge side first opening; and a cabinet side second opening that is located in a position opposed to the cartridge side second opening and is configured to supply the developer to the cartridge side second opening, wherein each of the cartridge side first opening, the cartridge side second opening, the cabinet side first opening and the cabinet side second opening extends in a substantially vertical direction, wherein the transport member configured to transport the developer from the cabinet side first opening to the cabinet side second opening, wherein a lower end of the cabinet side second opening is located in a position higher than a center of the transport member shaft in a vertical direction, and wherein the lower end of the cabinet side second opening is located in a position higher than the lower end of the cabinet side first opening in the vertical direction.

2. The developing device according to claim 1, further comprising:

an agitator including:

an agitator shaft supported inside the developer cartridge; and an agitating member which is provided on the agitator shaft and is configured to agitate the developer inside of the developer cartridge by rotating around the shaft, wherein a lower end of the cartridge side first opening is located in a position lower than a center of the agitator shaft in the vertical direction.

3. The developing device according to claim 1, wherein the cabinet side first opening and the cabinet side second opening are arranged in line in the longitudinal direction.

4. The developing device according to claim 1, wherein the cabinet side second opening is provided in both end portions in the longitudinal direction of the transport member.

5. The developing device according to claim 1, wherein the cabinet side first opening is larger than the cartridge side first opening.

6. The developing device according to claim 1, wherein the cartridge side second opening is larger than the cabinet side second opening.

7. An image forming apparatus comprising:

an image forming apparatus body; and a developing device that is attachable to and detachable from the image forming apparatus body, the developing device including:

a cabinet;

a developer carrier that is supported in the cabinet and is configured to carry developer;

a transport member that is supported in the cabinet and is configured to rotate around a transport member shaft and transport the developer to the developer carrier, the transport member shaft extending along a longitudinal direction of the developer carrier; and a developer cartridge that is attachable to and detachable from the cabinet and accommodates the developer, wherein the developer cartridge includes:

a cartridge side first opening that is configured to supply the developer to the cabinet; and a cartridge side second opening that is configured to receive the developer from the cabinet, wherein the cabinet includes:

a cabinet side first opening that is located in a position opposed to the cartridge side first opening and is configured to receive the developer from the cartridge side first opening; and a cabinet side second opening that is located in a position opposed to the cartridge side second opening and is configured to supply the developer to the cartridge side second opening, wherein each of the cartridge side first opening, the cartridge side second opening, the cabinet side first opening and the cabinet side second opening extends in a substantially vertical direction, wherein the transport member transports the developer from the cabinet side first opening to the cabinet side second opening, wherein a lower end of the cabinet side second opening is located in a position upper than a center of the transport member shaft in a vertical direction, and wherein the lower end of the cabinet side second opening is located in a position higher than the lower end of the cabinet side first opening in the vertical direction.

8. A developing device comprising:

a cabinet;

a developer carrier that is supported in the cabinet and is configured to carry developer;

a transport member that is supported in the cabinet and is configured to rotate around a transport member shaft and transport the developer to the developer carrier, the transport member shaft extending along a longitudinal direction of the developer carrier; and a developer cartridge that is attachable to and detachable from the cabinet and accommodates the developer, wherein the developer cartridge includes:

a cartridge side first opening that is configured to supply the developer to the cabinet; and a cartridge side second opening that is configured to receive the developer from the cabinet, wherein the cabinet includes:

a cabinet side first opening that is located in a position opposed to the cartridge side first opening and is configured to receive the developer from the cartridge side first opening; and a cabinet side second opening that is located in a position opposed to the cartridge side second opening and is configured to supply the developer to the cartridge side second opening, wherein each of the cartridge side first opening, the cartridge side second opening, the cabinet side first opening and the cabinet side second opening extends in a substantially vertical direction, wherein the transport member configured to transport the developer from the cabinet side first opening to the cabinet side second opening, a lower end of the cabinet side second opening is located in a position higher than a center of the transport member shaft in a vertical direction, and wherein the cabinet side first opening is larger than the cartridge side first opening.

9. A developing device comprising:

a cabinet;

a developer carrier that is supported in the cabinet and is configured to carry developer;

a transport member that is supported in the cabinet and is configured to rotate around a transport member shaft and transport the developer to the developer carrier, the transport member shaft extending along a longitudinal direction of the developer carrier; and a developer cartridge that is attachable to and detachable from the cabinet and accommodates the developer, wherein the developer cartridge includes:

a cartridge side first opening that is configured to supply the developer to the cabinet; and a cartridge side second opening that is configured to receive the developer from the cabinet, wherein the cabinet includes:

a cabinet side first opening that is located in a position opposed to the cartridge side first opening and is configured to receive the developer from the cartridge side first opening; and a cabinet side second opening that is located in a position opposed to the cartridge side second opening and is configured to supply the developer to the cartridge side second opening, wherein each of the cartridge side first opening, the cartridge side second opening, the cabinet side first opening and the cabinet side second opening extends in a substantially vertical direction, wherein the transport member configured to transport the developer from the cabinet side first opening to the cabinet side second opening, a lower end of the cabinet side second opening is located in a position higher than a center of the transport member shaft in a vertical direction, and wherein the cartridge side second opening is larger than the cabinet side second opening.

* * * * *